US006785194B1

(12) United States Patent
Peck et al.

(10) Patent No.: US 6,785,194 B1
(45) Date of Patent: Aug. 31, 2004

(54) METHOD AND APPARATUS FOR PRECISION TIME INTERVAL MEASUREMENT

(75) Inventors: Jeffrey V. Peck, Knoxville, TN (US); Dale A. Gedcke, Oak Ridge, TN (US); Russell D. Bingham, Knoxville, TN (US)

(73) Assignee: Advanced Measurement Technology, Inc., Oak Ridge, TN (US)

( * ) Notice: Subject to any disclaimer, the term of this patent is extended or adjusted under 35 U.S.C. 154(b) by 158 days.

(21) Appl. No.: 10/146,842

(22) Filed: May 15, 2002

(51) Int. Cl.[7] ..... G04F 10/00

(52) U.S. Cl. ..... 368/113; 368/118; 368/120; 370/518

(58) Field of Search ..... 368/113, 118, 368/120, 121, 107; 377/20, 34; 702/178; 370/516–520

(56) References Cited

U.S. PATENT DOCUMENTS 4,302,829 A * 11/1981 Morokawa et al. ..... 368/82
4,930,115 A * 5/1990 Verboom et al. ..... 369/59.24
6,122,281 A * 9/2000 Donovan et al. ..... 370/401
6,459,393 B1 * 10/2002 Nordman ..... 341/100

* cited by examiner

*Primary Examiner*—David Martin
*Assistant Examiner*—Thanh S. Phan
(74) *Attorney, Agent, or Firm*—Pitts & Brittain, P.C.

(57) ABSTRACT

A method and apparatus for precision time interval measurement in a time-of-flight mass spectrometer (TOF-MS). The method and apparatus produces an instrument capable of measuring bursts of data occurring at rates much higher than the average data rate. An asynchronous serial stream of data, consisting of a start pulse followed by an arbitrary number of stop pulses, repeated an arbitrary number of times, is converted into a digital stream of data synchronized to a precision master clock. Conversion of the asynchronous, analog data to synchronous digital data simplifies the measurement task by allowing the use of powerful, low-cost digital logic in the measurement.

10 Claims, 5 Drawing Sheets

METHOD AND APPARATUS FOR PRECISION TIME INTERVAL MEASUREMENT

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Scope of Invention

The invention relates to an improved time digitizer. More specifically, a time digitizer with improved time resolution and pulse-pair resolving time is described.

2. Description of the Related Art

Precision measurements of time intervals are important in many areas of science. One example is a time-of-flight mass spectrometer (TOF-MS). A TOF-MS is used to measure the mass spectrum of a chosen sample. The sample is injected into the TOF-MS system by one of a variety of techniques. Subsequently, the sample is ionized and accelerated toward an ion detector by a fixed amplitude voltage pulse. The TOF-MS system measures the mass of the molecules or molecular fragments by measuring the time required for the accelerated ions to travel the fixed distance of the TOF-MS chamber. Ions with the lowest mass and highest electrical charge arrive first at the ion detector. Heavier ions arrive later. A mass record is measured by recording the arrival time of each of the ions accelerated by a given voltage pulse. By repeating the process of injection, acceleration, and time measurement many times and combining the mass records obtained, a statistically significant graph of the total number of detected ions versus flight time is accumulated. This graph, called the mass spectrum, gives the relative number of molecules of different mass in the sample and is a valuable analytical tool.

Measurement of an accurate mass spectrum with the TOF-MS is technically difficult. The total time measurement interval for the heaviest ions may be several hundred microseconds while the time resolution required to accurately identify a given mass species might be a few hundred picoseconds. One method of measuring the flight time to a precision of a hundred picoseconds is to count the cycles of an electronic clock running at 10 gigahertz. Each cycle represents one hundred picoseconds of elapsed time so the number of cycles between the ion acceleration time and the final arrival time is the time of flight in 100-picosecond units. As each ion arrives, the counter total is written to a data list in memory. The list of flight times for each injection cycle is a mass record and the sum of many mass records produces the mass spectrum. A serious problem with a method of this type is the time required to store the arrival time. Reading the counter and storing the resulting value requires several nanoseconds, even using the fastest known memories. The result of such a measurement technique is time precision of one hundred picoseconds but an inability to measure two events occurring a few nanoseconds apart. In a TOF-MS, this measurement problem results in a serious error. An ion species having a mass just slightly higher than a species common in the sample will not be correctly measured. This error occurs because the heavier ion arrives at the detector during the dead time that is required to store the arrival time of the lighter ion.

In many areas of time measurement, the need to resolve closely spaced events does not imply a high average data rate. In the TOF-MS, for example, events separated by about one nanosecond must be resolved in order to prevent distortion of a mass peak by a nearby lighter ion species. This implies a burst data rate of one gigahertz. The actual average data rate is usually less than one megahertz.

It is an object of the invention to provide a design for a time digitizer having high precision and the ability to resolve closely spaced events without incurring the cost and complexity of a design capable of extremely high data rates.

BRIEF SUMMARY OF THE INVENTION

A method and apparatus for precision time interval measurement in a time-of-fight mass spectrometer (TOF-MS) is provided. An asynchronous serial stream of data, consisting of a start pulse followed by an arbitrary number of stop pulses, repeated an arbitrary number of times, is converted into a digital stream of data synchronized to a precision master clock. Conversion of the asynchronous, analog data to synchronous digital data simplifies the measurement task by allowing the use of powerful, low-cost digital logic in the measurement The synchronous digital data stream is separated into a sequence of digital words of fixed length, such that the bit pattern in the digital words is the same as the bit pattern in the serial digital data stream. Converting the data from a serial stream to a parallel stream reduces the effective data rate.

In principle, two separate channels could be used to analyze the start and stop pulses separately. The time difference between a start pulse and a subsequent stop pulses would be obtained in later processing. In practice, it is more cost-effective to combine the start and stop pulses into a single stream of data, distinguished by their bit pattern. A time interval with no pulses present is represented by a sequence of digital zeroes, one zero for each cycle of the master clock. A start pulse is represented by a short sequence of digital ones. A differing sequence of digital ones represents a stop pulse, thereby distinguishing the stop pulse from a start pulse.

The sequence of digital words is analyzed by a digital signal processing system. When the bit pattern representing a start pulse is recognized, the word number and bit position of the leading one is recorded in the output data stream. When the bit pattern representing a stop pulse is recognized in the same word as the start pulse or some word occurring later in the data, the word number and bit position of the leading one is recorded in the output data stream.

The data output of the signal processing system consists of a sequence of digital words containing a type marker, denoting whether the pulse was a start or stop pulse, followed by an input data word number and a bit position in that word. The width of the output data word is chosen so that the maximum desired time interval can be represented. Data words containing all zeroes are quickly recognized and counted. The described data processing results in an output data stream more compressed than the input data stream.

Final analysis to produce the mass spectrum is very simple. If the input data words are numbered starting from zero and the bit position is numbered from the left starting from zero, then the clock time for a given pulse is calculated by the equation:

$$\text{Time}=[(\text{Word Number})*(\text{Word Length})+(\text{Bit Position})]*(\text{Clock Cycle Time}).$$

The mass record is calculated by subtracting the start time from each stop time value until a new start time is reached. The mass records are combined to form the mass spectrum.

BRIEF DESCRIPTION OF THE SEVERAL VIEWS OF THE DRAWINGS

The above-mentioned features of the present invention will become more clearly understood from the following detailed description of the invention, read together with the drawings in which.

DETAILED DESCRIPTION OF THE INVENTION

A method and apparatus for precision time interval measurement in a data acquisition system is provided. The method and apparatus produces an instrument capable of measuring bursts of data occurring at rates much higher than the average data rate. An asynchronous serial stream of data, consisting of a start pulse followed by an arbitrary number of stop pulses, repeated an arbitrary number of times, is converted into a digital stream of data synchronized to a precision master clock. Conversion of the asynchronous, analog data to synchronous digital data simplifies the measurement task by allowing the use of powerful, low-cost digital logic in the measurement.

Figure 1:
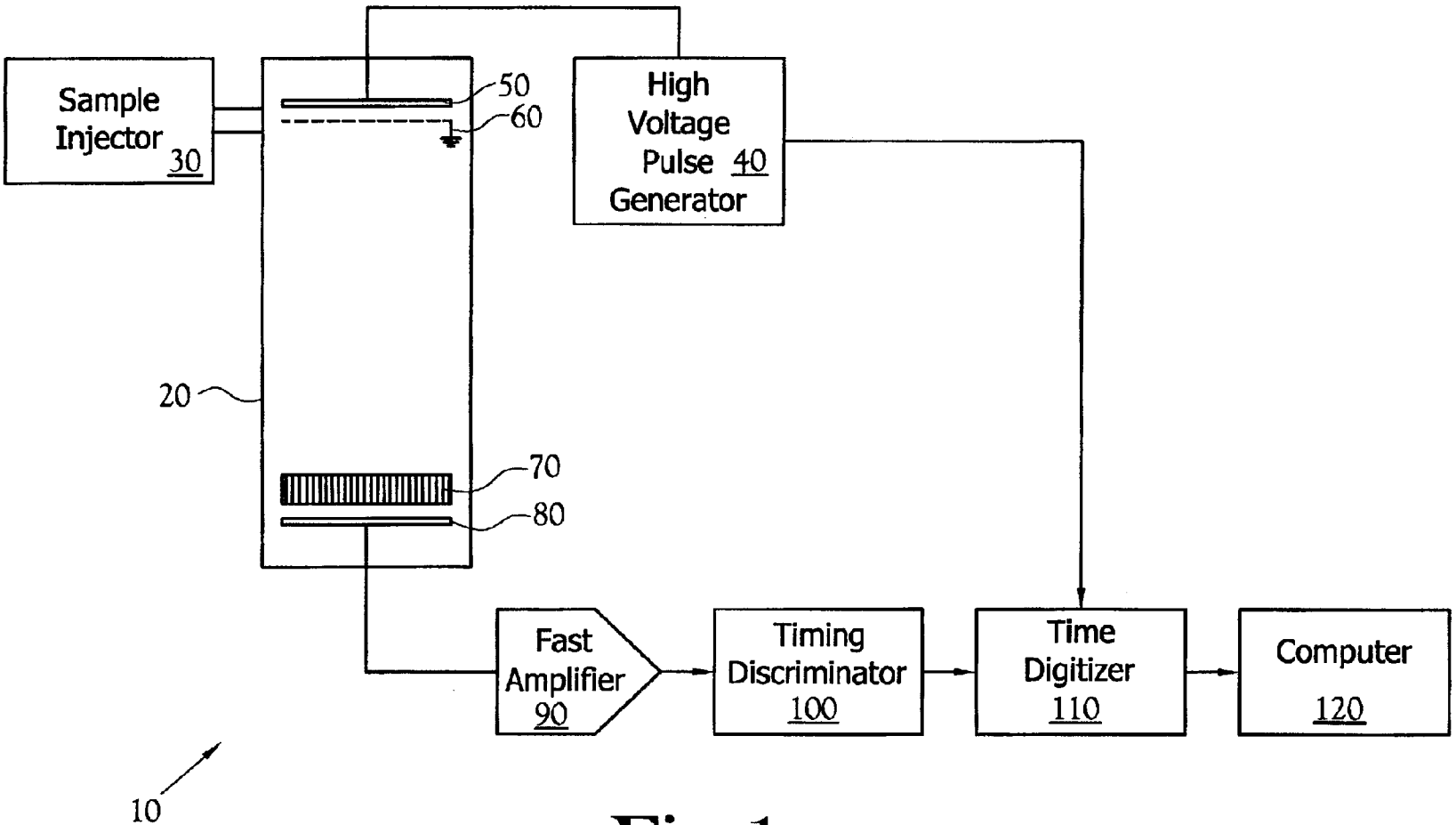
FIG. 1 depicts a conventional time-of-flight mass spectrometer (TOF-MS) system utilizing the precision time interval measurement method and apparatus of the present invention.

For discussion purposes, FIG. 1 illustrates a typical data acquisition system, a time-of-flight mass spectrometer (TOF-MS) system 10, utilizing the precision time interval measurement method and apparatus of the present invention. Those skilled in the art will recognize that the precision time interval measurement method and apparatus can be used in other types of data acquisition systems requiring precision interval measurements. An evacuated flight chamber provides the flight path for the ions whose mass is to be measured. A portion of the sample is ionized and injected into the flight chamber 20 by the sample injector 30. A high voltage pulse generator 40 generates a voltage pulse applied to an accelerator plate 50. The electric field between the accelerator plate 50 and a grounded grid 60 accelerates the ions down the flight chamber 20. Each arriving ion creates a number of electrons in the microchannel plate 70. An anode 80 collects the electrons and creates an electrical signal. The electrical signal is amplified by a fast amplifier 90 and fed into a timing discriminator 100. The timing discriminator 100 produces an output signal that represents the arrival time of the ion at the anode 80. A time digitizer 110 measures the flight time of the ion by measuring the time between the voltage pulse and the timing discriminator output, which produces a stream of numbers representing the flight time of each arriving ion. The flight time of each ion depends on its mass and electrical charge. Typically the lighter ions in the sample arrive first and the heaviest ions in the sample arrive last. The complete list of flight times for a single sample injection is called a mass record. The data in a single mass record is not statistically useful. However, when the data from many mass records is combined, the resulting mass spectrum contains the mass distribution of the sample. Data processing and storage occurs in a computer 120 in communication with the time digitizer 110.

The description and figures reference a time digitizer for a TOF-MS having a time resolution of 100 picoseconds and a pulse pair resolving time of less than one nanosecond. It will be recognized by those skilled in the art that the methods described are applicable to many other time measurements.

Figure 2:
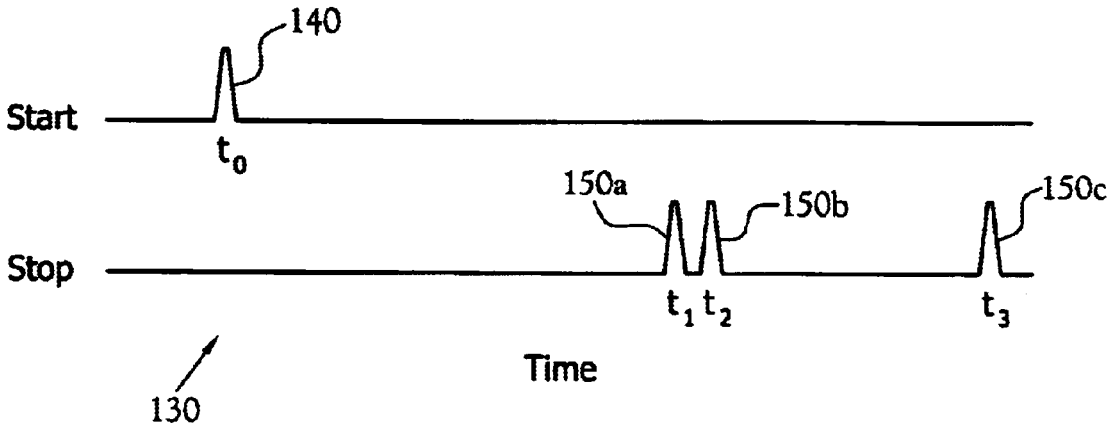
Fig.2 (PRIOR ART)
FIG. 2 depicts the time relationships between typical signal pulses from the TOF-MS.

FIG. 2 illustrates an example of the time distribution 130 of event signals into the time digitizer 110. The event signals include a start pulse 140 corresponding to the voltage pulse from the high voltage pulse generator 40 and at least one stop pulse 150 corresponding to the arrival of an ion at the anode 80. In the illustrated time distribution, a start pulse 140 occurs at a time, $t_0$, coincident in time with the voltage pulse. One stop pulse 150*a* occurs at a time, $t_1$, when a first ion arrives at the anode 80. Additional stop pulses occur when other ions arrive at the anode 80, including stop pulse 150*b* at time $t_2$ and stop pulse 150*c* occurs at time $t_3$. Assume, for example, that stop pulse 150*a* occurs 98,432.11 nanoseconds after to, stop pulse 150*b* occurs 1.12 nanoseconds later at time 98,433.23, and stop pulse 150*c* occurs 156,367.66 nanoseconds after time $t_0$.

Figure 3:
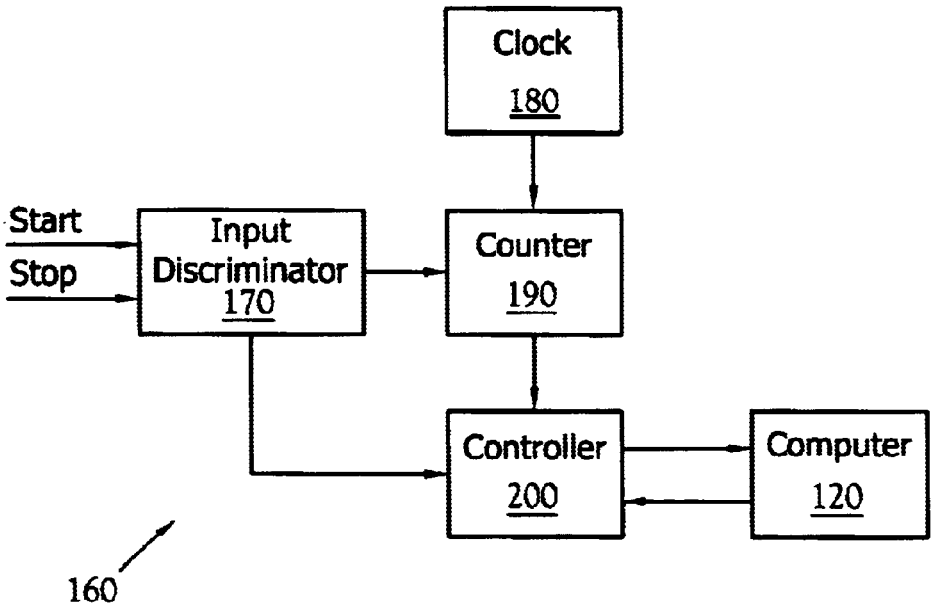
Fig.3 (PRIOR ART)
FIG. 3 is a block diagram of a time digitizer according to the prior art.

FIG. 3 illustrates a time digitizer 160 according to the prior art. An input discriminator 170 processes the start and stop pulses. A master clock 180 produces a pulse every 0.1 nanosecond. A counter 190 counts pulses from the master clock 180. When a controller 200 responsive to the input discriminator 170 detects a start or stop pulse, the current value of counter 190 is written to the output data list along with a tag denoting whether the pulse was a start or stop type pulse.

Figure 4:
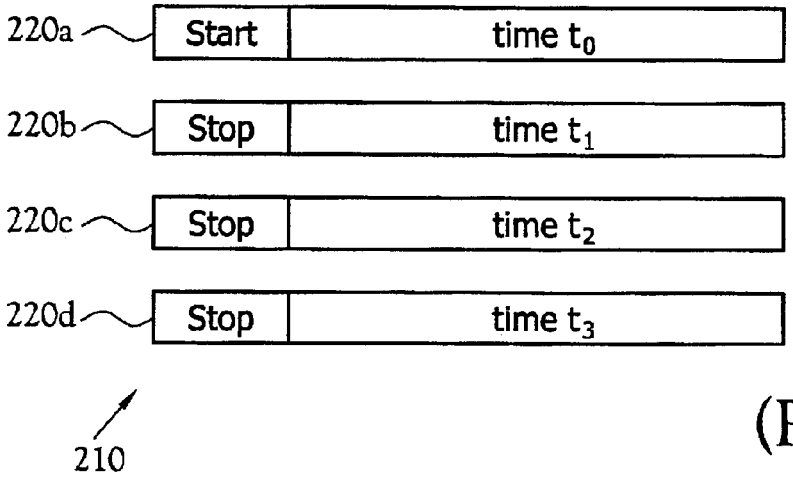
Fig.4 (PRIOR ART)
FIG. 4 is the data list from the prior art digitizer.

FIG. 4 illustrates a data list 210 from the prior art time digitizer 160 of FIG. 3. From the previous example, the start pulse at time $t_0$ produces data word 220*a*. Data word 220*a* consists of a single bit indicating that the data word represents a start type pulse, followed by a digital representation of the start time value $t_0$. For example, the start pulse is represented by a digital zero. Data word 220*b* starts with a digital one, representing a stop pulse, followed by a digital representation of the time $t_0$ plus the number of clock pulses between to and $t_1$, 984,321. Note that the time value is truncated to the integer number of pulses from the 0.1 nanosecond clock 180. Data word 220*c* contains the digital one denoting a stop type pulse, followed by a digital representation of the time to plus the number of clock pulses between $t_0$ and $t_2$, 984,332. The difference between the numbers stored for $t_1$ and $t_2$ is 11, denoting the time difference of 1.12 nanoseconds truncated to 11 clock pulses. If the prior art time digitizer 160 is not able to write two consecutive data words to memory in 1.1 nanoseconds, then data word 220*c* will be lost. Similarly, data word 220*d* contains a zero followed by a digital representation of the time $t_0$ plus the number of clock pulses between $t_0$ and $t_3$, 1,563,676.

Figure 5:
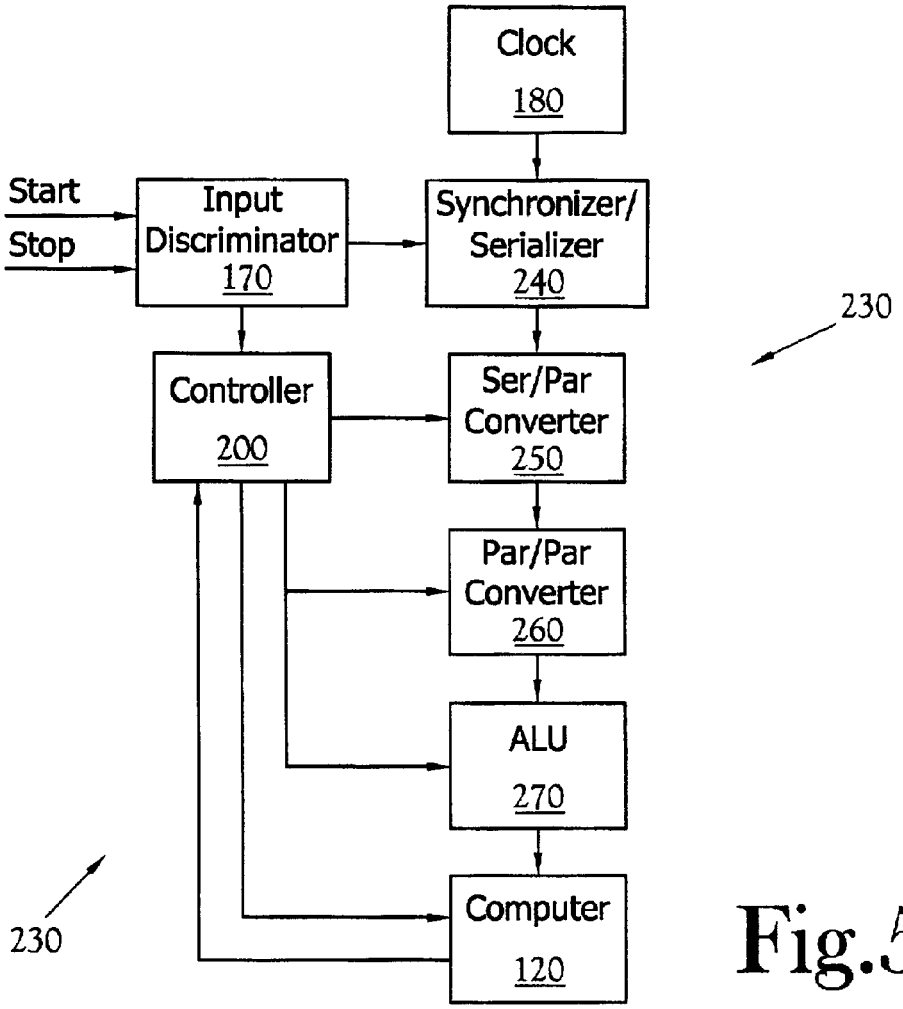
FIG. 5 is a block diagram of a time digitizer according to the present invention.

FIG. 5 illustrates a time digitizer 230 according to the present invention. An input discriminator 170 shapes start and stop pulses to provide fast rising pulses and produces a width for the start pulses that is different from the width of the stop pulses. The output of input discriminator 170 is fed into the synchronizer/serializer 240 where the asynchronous data stream is converted into a serial data stream synchronized to the master clock 180. In effect, the synchronizer/serializer 240 operates as a one-bit analog-to-digital converter (ADC) clocked by the master clock 180. At the rising edge of the master clock 180, the ADC samples the input data. If no pulse is present, the output value is a digital zero; if a pulse is present, the output value is a digital one. The output value contains a sequence of digital ones corresponding to the time width of the data pulse.

In principle, two separate channels could be used to analyze start and stop pulses separately. The time difference between a start pulse and a subsequent stop pulses would be obtained in later processing. In practice, it is more cost-effective to combine the start and stop pulses into a single stream of data, distinguished by their length. A time interval with no pulses present is represented by a sequence of digital zeroes, one zero for each cycle of the master clock. A start pulse is represented by a short sequence of digital ones. In the illustrated embodiment, a start pulse is represented by a zero followed by four consecutive ones and a stop pulse is represented by a zero followed by two consecutive ones.

A serial-to-parallel (STP) converter 250 converts the synchronous serial data stream to parallel digital words of fixed length containing the same sequence of digital zeroes and ones contained in the serial data stream. The width (number of bits) of the digital output is chosen to optimize the efficiency of the STP converter 250. Those skilled in the art will recognize that because of the very high clock rate of the input data, the converter 250 may require a custom semiconductor circuit. A parallel-to-parallel (PTP) converter 260 combines the parallel data words from the STP converter 250 into digital words having a width equal to an integer number times the input data width. The width of the data words from the PTP converter 260 is chosen to optimize the analysis of the resulting data. A wider word allows more analysis in parallel at a lower effective data rate, but requires more costly analysis circuitry. Those skilled in the art will recognize that the separation of the STP converter 260 and the PTP converter 260 into separate blocks is a matter of convenience and cost. Combining the STP converter 250 and the PTP converter 260 into a single circuit does not change the principle of operation.

Converting the data from a serial stream to a parallel stream reduces the effective data rate. If, for example, the clock rate is ten gigahertz, converting the serial data to words of 128 bits reduces the data rate by a factor of 128 to 78.125 megahertz. The time to analyze one item of data is increased from 100 picoseconds to 12.8 nanoseconds. An arithmetic logic unit (ALU) 270 examines the words from the PTP converter 260 and produces the output data list. The resulting data list is communicated to the computer 120 under the control of the controller 200.

Figure 6:
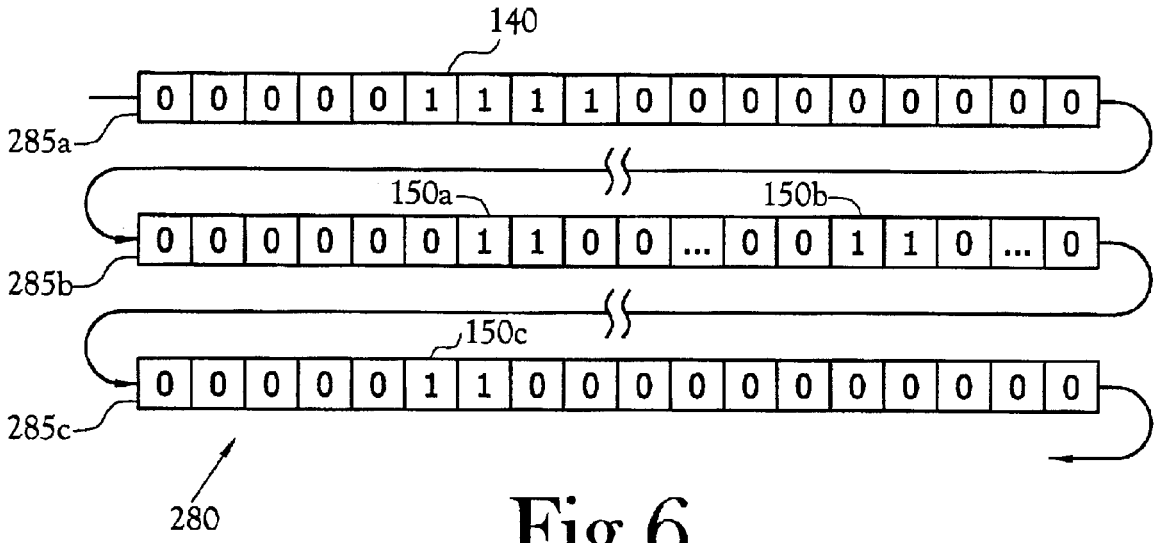
FIG. 6 depicts the serial data stream from the time digitizer of the present invention.

FIG. 6 represents the serial data stream 280 produced by the synchronizer/serializer 240 in response to the exemplary pulses illustrated in FIG. 2. The portion of the bit stream denoted by 285*a* shows the bit pattern of the example start pulse 140. The number of one bits is shown as four. If the actual time width of a start pulse is 350 picoseconds and the master clock 180 produces a rising edge every 100 picoseconds, the actual number of digital one bits could be either three or four, depending on the time relationship between the clock edge and time $t_0$. Stop pulse 150*a* occurs 984,321 clock ticks later so there are the three additional digital ones followed by 984,318 zeroes before the bit pattern representing stop pulse 150*a* appears in the bit stream at 285*b*. The bit pattern for stop pulse 150*b* occurs 11 bit positions later and the bit pattern for stop pulse 150*c* occurs 1,563,676 bit positions after start pulse 140.

The sequence of digital words is analyzed by a digital signal processing system. When the bit pattern representing a start pulse (a zero followed by four digital ones in the example) is recognized, the word number and bit position of the leading one is recorded in the output data stream. When the bit pattern representing a stop pulse is recognized, in the same word as the start pulse or some word occurring later in the data, the word number and bit position of the leading one is recorded in the output data stream.

The data output of the signal processing system consists of a sequence of digital words, the output data word, containing an event type identifier, denoting whether the pulse was a start or stop pulse, followed by a position identifier, which contains the input data word number and a bit position in that word. The width of the output data word is chosen so that the maximum desired time interval can be represented. For example, if the maximum time interval is 200 microseconds and the clock period is 100 picoseconds, the total number of data bits to be analyzed is two million. If the serial data stream is converted to words having 128 bits, the total number of data words being processed is 15,625 (two million bits divided by 128 bits). Binary data having fourteen (14) bits can represent a number up to 16,384. Therefore, the output data sequence requires words containing twenty-two (22) bits, one bit to represent the pulse type, start or stop, fourteen (14) bits representing the input word number, and seven (7) bits to represent the bit position in the 128-bit wide input data word.

Figure 7:
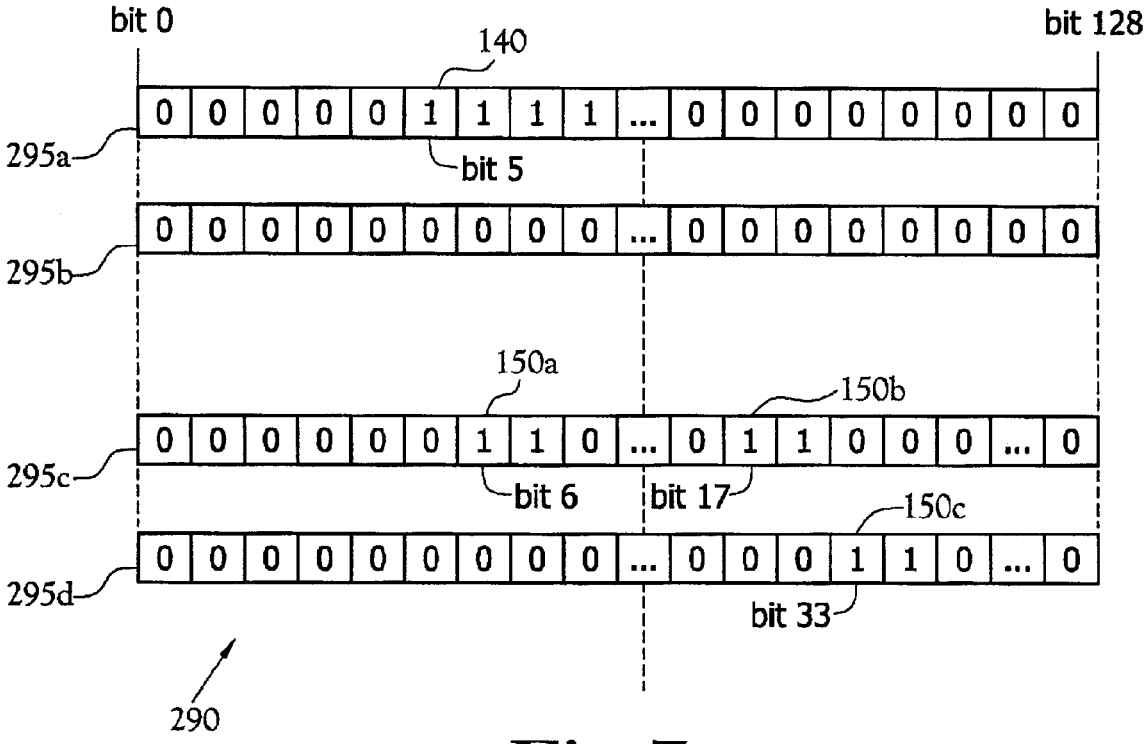
FIG. 7 depicts the serial data stream of FIG. 6 transformed into a sequence of data words.

FIG. 7 illustrates data word stream 290 as produced by the PTP converter 260 from the serial data stream shown in FIG. 6. Data word 295*a* contains the bit pattern representing the start pulse 140 at time to. The pattern is shown as starting at bit position 5 in word 295*a*. The actual bit position is arbitrary, depending on the relationship between time $t_0$ and the word boundary time of the STP converter 250. The first example stop pulse 150*a* occurs at $t_1$, 984,321 clock pulses after to. Accordingly, there are three digital ones and 984,318 zeroes between the bit representing start pulse 140 at time $t_0$ and stop pulse 150*a* at time $t_1$. Dividing 984,321 by 128 yields 7,690 complete words plus one remainder bit. There will be 7,689 words containing all zeroes between data word 295*a* and data word 295*b*. Thus, if data word 295*a* is word number zero, there are 7,689 all zero data words similar to data word 295*b* following data word 295*a* followed by data word 295*c* representing word number 7,690. The bit pattern representing stop pulse 150*a* starts at bit position 6, one position higher than the bit position of the start pulse 140. Stop pulse 150*b* occurs 11 clock ticks after stop pulse 150*a*. There is a digital one in bit position 17 of data word 295*c* representing the beginning of stop pulse 150*b* at time $t_2$. Stop pulse 150*c* occurs 1,563,676 clock pulses after start pulse 140. Dividing 1,563,676 by 128 yields 12,216 with a remainder of 28. The bit pattern representing stop pulse 150*c* occurs in data word 295*d* representing word number 12,216 at bit position 33.

Figure 8:
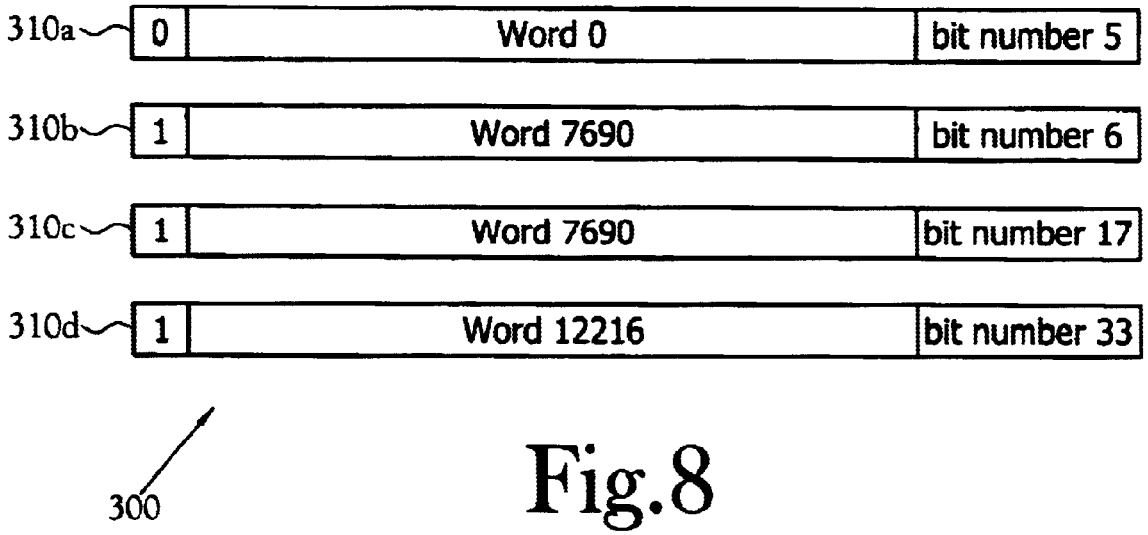
FIG. 8 is the data list to the computer according to the present invention.

FIG. 8 illustrates the mass record 300 produced by the ALU 270. The stream of parallel words 290 from the PTP converter 260 is examined one at a time by the ALU 270. A fast circuit designed to recognize a pattern of all zeroes increments a counter each time such a word is processed.

When a word containing a zero to one bit transition is located, the pulse type is determined by the consecutive count of one bits. The pulse type, start or stop, the word number, and the bit position of the zero to one transition are then written to the output mass record 300. For example, the start pulse occurring at time $t_0$ was at bit position five in the word arbitrarily counted as word zero. Mass record word 310*a* contains a zero in bit position zero, denoting a start type pulse; followed by fourteen (14) bits representing the word number zero; followed by seven (7) bits representing the number five. The stop pulse occurring at time $t_1$ is in word number 7,690 at bit position six. Mass record word 310*b* contains a one in bit position zero, denoting a stop type pulse; followed by fourteen (14) bits representing the word count 7690; followed by seven (7) bits representing the bit position six. Mass record word 310*c* similarly contains a stop bit, the word count 7,690 and the bit count 17. Mass record word 310*d* contains a stop bit, the word count 12,216 and the bit count 33.

If the ions in a TOF-MS arrive at the detector at a rate of one megahertz, the average time between pulses is one microsecond. A time of one microsecond is represented by ten thousand cycles of the ten-gigahertz master clock. Thus, the average time interval between data events is represented by 78 data words (ten thousand divided by 128) containing nothing but zeroes. Data words containing all zeroes are quickly recognized and counted. The described data processing results in an output data stream much simpler than the input data stream. For the example chosen, an input data stream of 128-bit words arriving at a rate of one word in 12.8 nanoseconds results in an output data stream of 22-bit words arriving at an average rate of one word in one microsecond.

Figure 9:
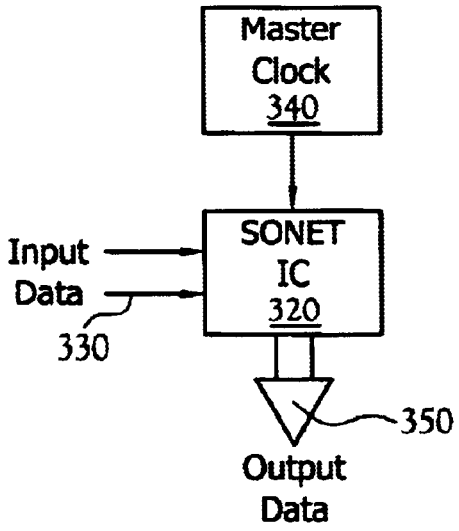
Fig.9 (PRIOR ART)
FIG. 9 is a block diagram of a synchronous optical network (SONET) integrated circuit.

High-speed optical communications networks use a standard known as Synchronous Optical NETwork (SONET). In this system high-speed digital communications signals are multiplexed into an optical fiber. At the receiving end the optical signals are converted to electrical signals, synchronized to a precision master clock and converted into digital words of a fixed length, typically 16 bits. FIG. 9 illustrates a system utilizing a SONET integrated circuit (IC) 320. The electrical signal input 330 is typically a differential input signal derived from the optical fiber. The master clock 340 is a multiple of the standard communications frequency 51.84 megahertz. One common frequency in use is 9953.280 megahertz, 192 times the standard frequency. The SONET IC 320 resynchronizes the input data 330 to the clock 340 and converts the resulting digital data stream to a stream of 16-bit parallel words 350.

The measurement task addressed by the current invention is to accurately measure time intervals in an analog and completely asynchronous data stream. The SONET IC 320 is designed to accurately reproduce a digital data stream originally synchronous with an extremely accurate atomic clock. Despite this enormous difference in design intent, the block diagram of the SONET IC 320 in FIG. 9 is almost identical to the functions of the synchronizer/serializer 240 and the STP converter 250 of FIG. 5. By replacing the master clock 340 of FIG. 9, running at 9.95328 gigahertz, with clock (280) 180 of FIG. 5, running at 10.00 gigahertz, the SONET IC can thus be used to implement the most time critical task of the current invention. By using an integrated circuit produced for a very large market, the measurement can be performed by an instrument with much lower cost than would otherwise be necessary.

Final analysis to produce the mass spectrum is very simple. If the input data words are numbered starting from zero and the bit position is numbered from the left starting from zero, then the clock time for a given pulse is calculated by the equation:

$$\text{Time}=[(\text{Word Number})*(\text{Word Length})+(\text{Bit Position})]*(\text{Clock Cycle Time})$$

The mass record is calculated by subtracting the start time from each stop time value until a new start time is reached. The mass records are combined to form the mass spectrum.

While a preferred embodiment has been shown and described, it will be understood that it is not intended to limit the disclosure, but rather it is intended to cover all modifications and alternate methods falling within the spirit and scope of the invention as defined in the appended claims.

Having thus described the aforementioned invention, we claim:

1. A time digitizer for use in a data acquisition system, said time digitizer comprising:

an input circuit for accepting an event signal, said event signal having an arbitrary arrival time;

a clock circuit defining a time reference;

a synchronizing circuit in electrical communication with said input circuit and said clock circuit, said synchronizing circuit producing a serial data stream of digital data bits corresponding to said event signal arrival time, said serial data stream synchronized to said time reference;

a serial-to-parallel conversion circuit in electrical communication with said synchronizing circuit, said serial-to-parallel conversion circuit producing a parallel data stream of data packets containing a number of digital data bits, said parallel data stream digital data bits being organized in a sequence corresponding to said serial data stream digital data bits;

a processing unit in electrical communication with said serial-to-parallel conversion circuit, said processing unit producing a data list including at least an event type identifier and a position identifier corresponding to a position of said event signal within said parallel data stream.

2. The time digitizer of claim 1 wherein said event type identifier is at least one data bit having a value representing either of a start signal or a stop signal.

3. The time digitizer of claim 1 wherein said event signal is identified by a state transition within said data packet, said position identifier uniquely identifying said data packet and a relative position within said data packet corresponding to said state transition.

4. The time digitizer of claim 1 wherein said data packets contain a fixed number of digital data bits.

5. The time digitizer of claim 1 wherein said parallel data stream digital data bits are organized in a sequence identical to said serial data stream digital data bits.

6. The time digitizer of claim 1 wherein said serial-to-parallel conversion circuit and said synchronizing circuit is a synchronous optical network integrated circuit.

7. A method for precision time interval measurement in a data acquisition system, said method comprising the steps of:

(a) identifying an event occurring in a data acquisition system;

(b) classifying said event as either of a start signal and a stop signal;

(c) producing a serial data stream referenced to a master clock;

(d) marking said event in said serial data stream using an event identifier distinguishing said start signal from said stop signal, said serial data stream including a plurality of data bits;

(e) storing a number of said plurality of data bits as a data word;

(f) counting each said data word to determine a data word identification number;

(g) determining a offset value corresponding to a bit position within said data word where said event identifier occurs; and (h) generating an output including a event type value corresponding to said event identifier, said data word identification number, and said offset value.

8. The method of claim 7 wherein said step of storing a number of said plurality of data bits as a data word stores a fixed number of said plurality of data bits.

9. An apparatus for precision time interval measurement in a data acquisition system, said apparatus comprising:

means for producing a reference time;

means for synchronizing a serial data stream to said reference time, said serial data stream including a plurality of data bits;

means for identifying said event as one of a start signal and a stop signal and producing an event identifier;

means for marking said event in said serial data stream using said event identifier, means for grouping a number of said plurality of data bits into a data word;

means for placing said data word into a parallel data stream;

means for identifying a data word containing an event identifier;

means for determining a position of said data word containing an event identifier within said parallel data stream;

means for determining an offset value corresponding to a bit position within said data word where said event identifier occurs; and means for producing an output including a value corresponding to said event identifier, said data word position, and said offset value.

10. The apparatus of claim 9 wherein said data word is a fixed number of said plurality of data bits.

* * * * *